US008834709B2

(12) United States Patent
Choudhary et al.

(10) Patent No.: US 8,834,709 B2
(45) Date of Patent: Sep. 16, 2014

(54) PROCESS TO PARTIALLY UPGRADE SLURRY OIL

(75) Inventors: Tushar Choudhary, Bartlesville, OK (US); Ayyappan Subbiah, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 254 days.

(21) Appl. No.: 13/328,670

(22) Filed: Dec. 16, 2011

(65) Prior Publication Data

US 2013/0092600 A1 Apr. 18, 2013

Related U.S. Application Data

(60) Provisional application No. 61/429,575, filed on Jan. 4, 2011.

(51) Int. Cl.

| | |
|---|---|
| ***C10G 11/10*** | (2006.01) |
| ***C10G 11/18*** | (2006.01) |
| ***C10G 11/05*** | (2006.01) |
| ***C10G 49/08*** | (2006.01) |
| ***C10G 51/02*** | (2006.01) |
| ***C10G 69/04*** | (2006.01) |
| ***C10G 49/00*** | (2006.01) |

(52) U.S. Cl.

CPC ..... *C10G 11/10* (2013.01); *C10G 11/18* (2013.01); *C10G 11/05* (2013.01); *C10G 2300/301* (2013.01); *C10G 49/08* (2013.01); *C10G 51/026* (2013.01); *C10G 69/04* (2013.01); *C10G 49/002* (2013.01); *C10G 2300/701* (2013.01)

USPC ..... 208/113; 208/100; 208/106; 208/107; 208/108; 208/109; 208/118; 208/125

(58) Field of Classification Search

CPC ..... C10G 11/05; C10G 11/10; C10G 65/12; C10G 49/002; C10G 49/08; C10G 51/026; C10G 65/10; C10G 69/00

USPC ..... 208/100, 106–109, 113, 118, 125

See application file for complete search history.

(56) References Cited

U.S. PATENT DOCUMENTS

| | | | | |
|---|---|---|---|---|
| 4,302,323 | A * | 11/1981 | Chen | 208/89 |
| 4,585,545 | A | 4/1986 | Yancey, Jr. et al. | |
| 4,992,607 | A | 2/1991 | Harandi et al. | |
| 5,401,389 | A * | 3/1995 | Mazzone et al. | 208/89 |
| 5,685,972 | A | 11/1997 | Timken et al. | |
| 6,569,316 | B2 | 5/2003 | Winter | |

OTHER PUBLICATIONS

Sadeghbeigi, R. (2012). Fluid Catalytic Cracking Handbook:: An Expert Guide to the Practical Operation, Design, and Optimization of FCC Units, 3rd ed., Butterworth-heinemann, 352 pgs.*

* cited by examiner

*Primary Examiner* — Brian McCaig
(74) *Attorney, Agent, or Firm* — Phillips 66 Company

(57) ABSTRACT

A process of producing a light oil stream from slurry oils. The process begins by obtaining slurry oil from a fluid catalytic cracking unit. The slurry oil is then flowed over a fixed bed catalyst, consisting essentially of a non-metal catalyst, to produce a processed slurry oil. The processed slurry oil is then separated by boiling point to separate out the light oil stream.

11 Claims, 2 Drawing Sheets

PROCESS TO PARTIALLY UPGRADE SLURRY OIL

CROSS-REFERENCE TO RELATED APPLICATIONS

This application is a non-provisional application which claims the benefit of and priority to U.S. Provisional Application Ser. No. 61/429,575 filed Jan. 4, 2011, entitled "Process to Partially Upgrade Slurry Oil," which is hereby incorporated by reference in its entirety.

FIELD OF THE INVENTION

A process to partially upgrade slurry oil.

BACKGROUND

Slurry oil which is a byproduct from fluid catalytic cracking units are low valued and becoming even less valued as high sulfur slurry oil is becoming less acceptable in fuel oils. Slurry oil is composed of a large concentration of polyaromatic compounds and a smaller concentration of one-ring aromatics and saturates. From a fuel viewpoint the one ring aromatic compounds and saturates are far superior to polyaromatics. There exists a need to separate the one ring aromatic compounds and saturates in slurry oil from the polyaromatics.

SUMMARY

A process of producing a light oil stream from slurry oils. The process begins by obtaining slurry oil from a fluid catalytic cracking unit. The slurry oil is then flowed over a fixed bed catalyst, consisting essentially of a non-metal catalyst, to produce a processed slurry oil. The processed slurry oil is then separated by boiling point to separate out the light oil stream.

BRIEF DESCRIPTION OF THE DRAWINGS

A more complete understanding of the present invention and benefits thereof may be acquired by referring to the follow description taken in conjunction with the accompanying drawings in which.

DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment describes a situation where slurry oil is initially taken from a fluid catalytic cracking unit. The slurry oil is flowed over a fixed bed catalyst, consisting essentially of a non-metal catalyst, to produce a processed slurry oil. The processed slurry soil is then separated by boiling point to produce a light cycle oil stream.

Figure 1:
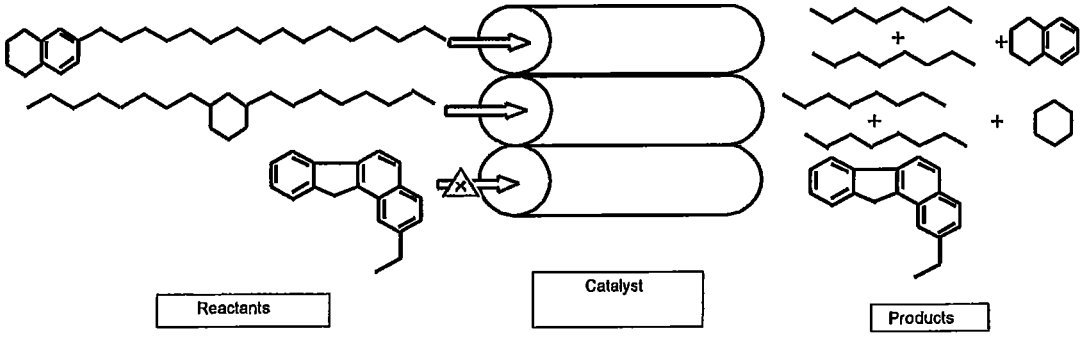
FIG. 1 depicts the how the processed is performed.

FIG. 1 depicts a situation where the first two molecules can enter the channels of the catalyst to crack to light cycle oil constituents, also known as lower boiling components. The third molecule shown cannot enter the channel and will not be converted. Eventually boiling point differences between the molecules will allow for easy separation of the low value material (unconverted) from the high value (converted by cracking) material. There is an additional benefit that the low value material is now concentrated with large aromatic compounds which will make it a better feedstock for increasing coke yield and quality at a refinery coker unit.

Reactant

The slurry oil is typically derived from a fluidized catalytic cracker unit, and is a highly aromatic or refractory oil which typically has an average boiling point as herein defined of about 700° F., and a gravity in the range of from about 9° API to about 15° API. This slurry oil typically has an initial boiling point (IBP) at atmospheric pressure which is at least as high as 550° F. Preferably, the slurry oil has an initial boiling point (IBP) at atmospheric pressures which is from about 775° to about 800° F., and has a gravity of from about 10.5° API to about 12.5° API. Importantly, the end point of this slurry oil will be below 1,000° F. The slurry oil, usually constituting the heaviest fraction of product from the catalytic cracker, will generally carry from about 400 ppm to about 4000 ppm of catalyst fine particles, and more typically from about 1,000 ppm to about 3,000 ppm.

Typically the slurry oil comprises a large concentration of poly-aromatic compounds and a smaller concentration of one-ring aromatics and saturates. One ring aromatic compounds and saturates are preferred in fuel over polyaromatics due to higher octane numbers.

Catalyst

In one embodiment the catalyst is a non-metal catalyst. In another embodiment the catalyst is a zeolite catalyst. Structures of the zeolite catalyst can be mordenite framework inverted, faujasite, mordenite, beta or combinations thereof. In an alternate embodiment the catalyst can be a ZSM-5 catalyst.

Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, B or Fe, within the zeolitic framework. These medium pore zeolites are favored for acid catalysis; however, the advantages of ZSM-5 structures may be utilized by employing highly siliceous material or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The zeolite catalysts preferred for use herein include the medium pore (i.e., about 5-7A) shape-selective crystalline aluminosilicate zeolites having a silica-to-alumina ratio of at least 12, a constraint index of about 1 to 12 and acid cracking activity of about 1-200. In an operating reactor the coked catalyst may have an apparent activity (alpha value) of about 1 to 80 under the process conditions to achieve the required degree of reaction severity. Representative of the ZSM-5 type zeolites are ZSM-5, ZSM-11, ZSM-12, ZSM-22, ZSM-23, ZSM-35 and ZSM-38. ZSM-5 is disclosed in U.S. Pat. No. 3,702,886 and U.S. Pat. Re. No. 29,948. The ZSM-5 and ZSM-12 catalyst are preferred. Other suitable zeolites are disclosed in U.S. Pat. Nos. 3,709,979; 3,832,449; 4,076,979; 4,076,842; 4,016,245 and 4,046,839; 4,414,423; 4,417,086; 4,517,396 and 4,542,251. The disclosures of these patents are incorporated herein by reference. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica and/or alumina binder.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5 having a silica:alumina molar ratio of 25:1 to 70:1 with an apparent alpha value of 1-80 to convert 80 to 100 percent, preferably at least 90%, of the $C_2$-$C_3$ olefins in the feedstock and to convert 1 to 50% preferably at least 5% of the $C_6$-$C_8$ aromatics in the feedstock.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02-1 micron being preferred. The zeolite catalyst crystals are normally bound with a suitable inorganic oxide, such as silica, alumina, etc. to provide a zeolite concentration of about 5 to 95 wt. %. A preferred catalyst comprises 25% to 65% H-ZSM-5 catalyst contained within a silica-alumina matrix binder and having a fresh alpha value of less than 80.

When employing a ZSM-5 type zeolite catalyst in extrudate form such as a catalyst the zeolite should be suitably bound or impregnated on a suitable support.

The light paraffin production and alkyl aromatic production is promoted by zeolite catalysts having a high concentration of Bronsted acid reaction sites. Accordingly, an important criterion is selecting and maintaining the catalyst to provide either fresh catalyst having acid activity or by controlling catalyst deactivation and regeneration rates. In another embodiment the surface acidity of the zeolite may be modified using known methods, such as silylation of surface acid sites In certain embodiments, the catalyst may be reused via one or more regeneration methods known in the art (e.g. by removing coke using an air burn).

Products

The products produced from the reaction would include a light oil stream. The light oil stream can have a boiling range less than 650° F. or in another embodiment have a boiling range from 250° F. to 650° F. Components in the light oil stream include alkyl-benzenes, alkanes, alkyl-naphthenes, di-ring aromatics Other constituents from the reaction include substituted tri-ring aromatics, substituted di-ring aromatics, substituted four-ring aromatics.

Reaction Conditions

The temperature of the reaction can range from 500° F. to 900° F. In one embodiment the temperature is from 670° F. to 770° F.

The pressure of the reaction can be less than 1,000 psig, less than 550 psig, or even from 200 to 300 psig. In one embodiment the gas in the reaction area is $H_2$.

The liquid hourly space velocity ranges from 0.1 to 2 $h^{-1}$. In one embodiment the liquid hourly space velocity ranges from 0.25 to 0.75 $h^{-1}$.

The following examples of certain embodiments of the invention are given. Each example is provided by way of explanation of the invention, one of many embodiments of the invention, and the following examples should not be read to limit, or define, the scope of the invention.

EXAMPLE 1

Figure 2:
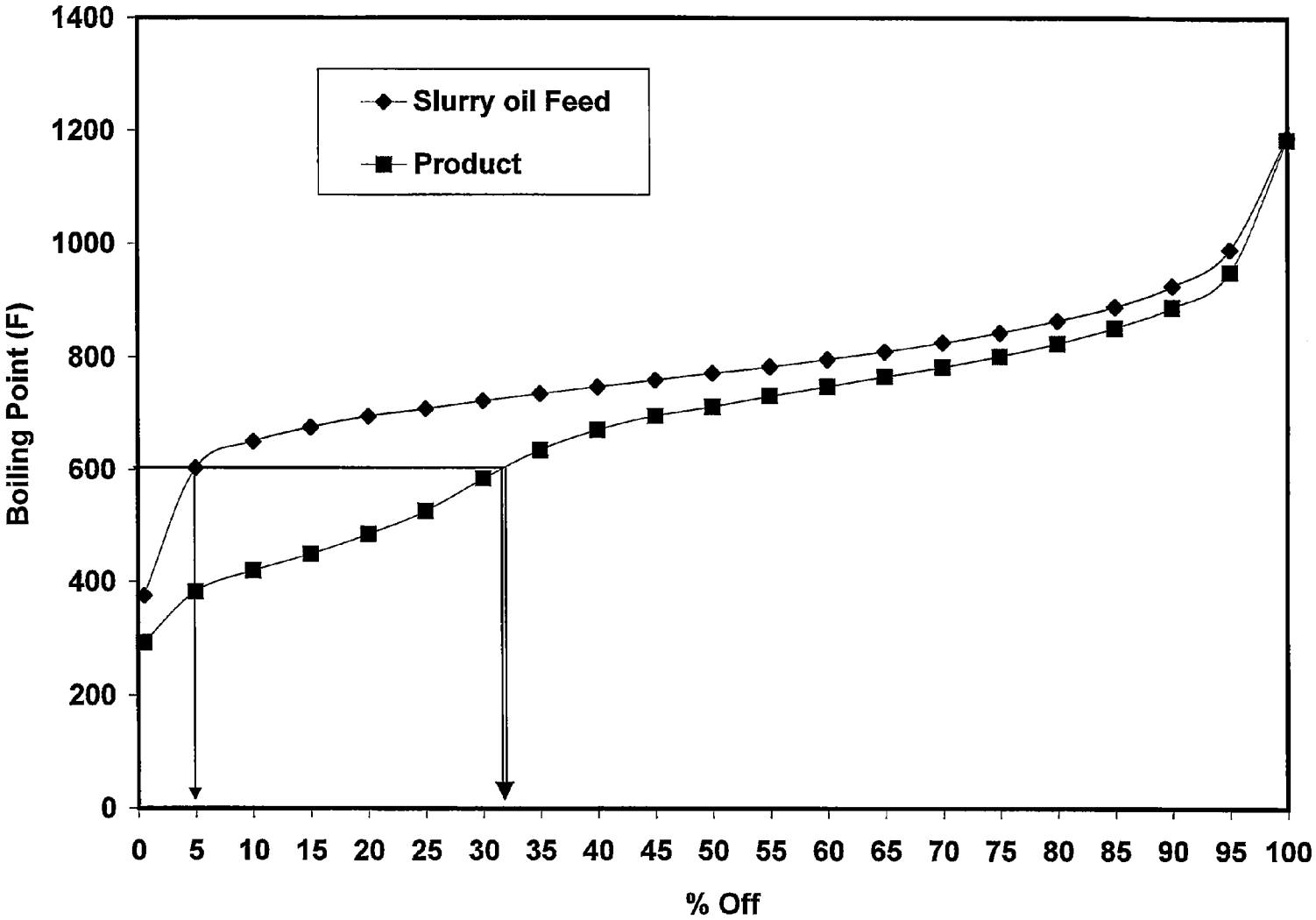
FIG. 2 depicts the boiling points after the slurry oil is processed.

Slurry oil was processed over H-ZSM-5 zeolite (T=720 F; P=500 psig and LHSV=0.5 $h^{-1}$; $H_2$/oil=5000 SCF/BBL; time=21 hours) to a product wherein the higher value components were cracked into smaller components (product has lower boiling curve). As shown in the table below and FIG. 2, the 600° F. minus fraction was increased from 5% in the slurry oil feed to >30% in the product. This product (<600° F.) which is diesel range material (high value) can be easily separated using conventional fractionation equipment at the refineries.

| Sample % recovered | Slurry Oil (Feed) Temp, ° F. | Product Temp, ° F. |
|---|---|---|
| 0.5 | 375 | 292 |
| 5 | 602 | 382 |
| 10 | 650 | 419 |
| 15 | 676 | 449 |
| 20 | 695 | 484 |
| 25 | 709 | 525 |
| 30 | 723 | 584 |
| 35 | 736 | 635 |
| 40 | 748 | 672 |
| 45 | 760 | 696 |
| 50 | 772 | 713 |
| 55 | 784 | 732 |
| 60 | 796 | 748 |
| 65 | 810 | 766 |
| 70 | 826 | 783 |
| 75 | 844 | 802 |
| 80 | 865 | 825 |
| 85 | 890 | 853 |
| 90 | 926 | 889 |
| 95 | 990 | 951 |

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising of:

a) obtaining slurry oil from a fluid catalytic cracking unit wherein the slurry oil carries from about 400 ppm to about 4000 ppm of catalyst fine particles;

b) flowing the slurry oil over a fixed bed catalyst, consisting essentially of a zeolite catalyst, to produce a processed slurry oil; and c) separating the processed slurry oil by boiling point to separate out a light cycle oil stream.

2. The process of claim 1, wherein the slurry oil is flowed over the fixed bed catalyst at a temperature from 670° F. to 770° F.

3. The process of claim 1, wherein the slurry oil is flowed over the fixed bed catalyst at pressures less than 550 psig.

4. The process of claim 1, wherein the slurry oil has a boiling range from 375° F. to 1200° F.

5. The process of claim 1, wherein the light cycle oil stream has a boiling range less than 650° F.

6. The process of claim 1, wherein the light cycle oil stream has a boiling range from 250° F. to 650° F.

7. The process of claim 1, wherein the zeolite catalyst has a structure selected from the group consisting of: mordenite framework inverted, faujasite, mordenite, beta and combinations thereof.

8. The process of claim 1, wherein the catalyst is a ZSM-5 catalyst.

9. The process of claim 1, further comprising the steps of regenerating the catalyst for reuse, repeating steps a through c, and reusing the catalyst in step b.

10. A process comprising of:

a) obtaining slurry oil from a fluid catalytic cracking unit wherein the slurry oil carries from about 400 ppm to about 4000 ppm of catalyst fine particles;

b) flowing the slurry oil over a fixed bed catalyst at a temperature from 670° F. to 770° F. and at pressures less than 550 psig, consisting essentially of a ZSM-5 catalyst, to produce a processed slurry oil; and c) separating the processed slurry oil by boiling point to separate out a light cycle oil stream wherein the light cycle oil stream has a boiling range from 250° F. to 650° F.

11. The process of claim 10, further comprising the steps of regenerating the catalyst for reuse, repeating steps a through c, and reusing the catalyst in step b.

* * * * *